United States Patent [19]

McMurtrie

[11] Patent Number: 5,016,656

[45] Date of Patent: May 21, 1991

[54] CIGARETTE AND METHOD OF MAKING SAME

[75] Inventor: Andrew McMurtrie, Louisville, Ky.

[73] Assignee: Brown & Williamson Tobacco Corporation, Louisville, Ky.

[21] Appl. No.: 481,925

[22] Filed: Feb. 20, 1990

[51] Int. Cl.[5] ..... A24D 1/00

[52] U.S. Cl. ..... 131/364; 131/360; 131/372

[58] Field of Search ..... 131/360, 364, 375, 372

[56] References Cited

U.S. PATENT DOCUMENTS 3,385,302 5/1968 Wattenford ..... 131/360

4,452,260 6/1984 Porenski et al. ..... 131/364

4,825,885 5/1989 Kounnas ..... 131/360

*Primary Examiner*—V. Millin

*Assistant Examiner*—Lynne A. Reichard

*Attorney, Agent, or Firm*—Charles G. Lamb

[57] ABSTRACT

A cigarette including a tube of tobacco having a circumferential wall fabricated of a tobacco material with ridges and grooves from in the circumferential wall extending longitudinally of the tobacco tube, a wrapper of combustible material circumscribing the outside peripheral surface, and a filter rod attached at one end of the tobacco tube. Also, a method of making a cigarette includes forming a sheet of tobacco material, forming corrugations in the sheet of tobacco material and forming the corrugated sheet into a cylindrical tube.

8 Claims, 4 Drawing Sheets

CIGARETTE AND METHOD OF MAKING SAME

BACKGROUND OF THE INVENTION

The present invention relates to cigarettes and more particularly to a cigarette having a corrugated tobacco rod or column, and a method of making such a tobacco rod.

Cigarettes are typically made with a tobacco rod of a packed tobacco material and are generally circular or oval in transverse cross-section.

SUMMARY OF THE INVENTION

The present invention provides a cigarette tobacco rod or column which is stronger to resist bending than are packed tobacco rods.

More particularly, the present invention provides a cigarette having a generally cylindrical tube of tobacco material, the circumferential wall of the tobacco tube having corrugations oriented with the ridges and grooves of the corrugations extending longitudinally of the tobacco tube the entire length thereof, a wrapper of combustible material circumscribing the outside peripheral surface of the tobacco tube in contact with the ridges of the corrugations, a smoke filter rod coaxially located with the tobacco tube at one end thereof, and tipping material circumferentially overlapping the wrapped tobacco tube at the end thereof adjacent the filter rod.

The present invention also provides a method of making a cigarette comprising the steps of forming a sheet of tobacco material, forming corrugations in the sheet of tobacco material, forming the corrugated sheet of tobacco material into a generally cylindrical tube with the ridges and grooves of the corrugations extending longitudinally of the tube, wrapping a sheet of combustible material circumferentially around the tube of tobacco, locating a smoke filter rod coaxially with the tube of tobacco at one end thereof, and folding a tipping material circumferentially overlapping the wrapped tube of tobacco at the end of the tube of tobacco adjacent the filter rod.

BRIEF DESCRIPTION OF THE DRAWINGS

A better understanding of the invention will be had upon reference to the following discussion in conjunction with the accompanying drawings wherein the numerals refer to like features throughout the several views and in which.

DETAILED DESCRIPTION OF THE PREFERRED EMBODIMENTS

Figure 1:
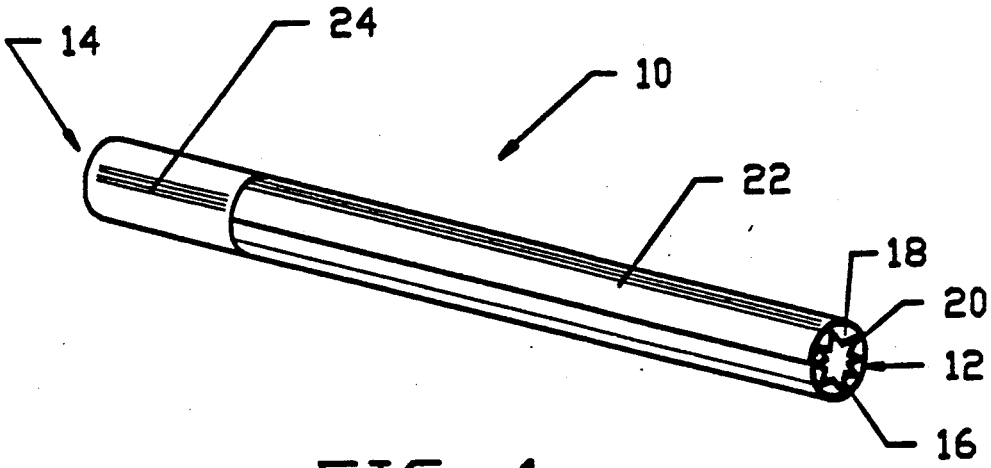
FIG. 1 is a perspective view of a preferred cigarette of the present invention.
Figure 2:
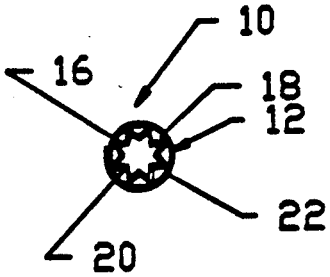
FIG. 2 is an end view of the tobacco end of the cigarette of FIG. 1.
Figure 3:
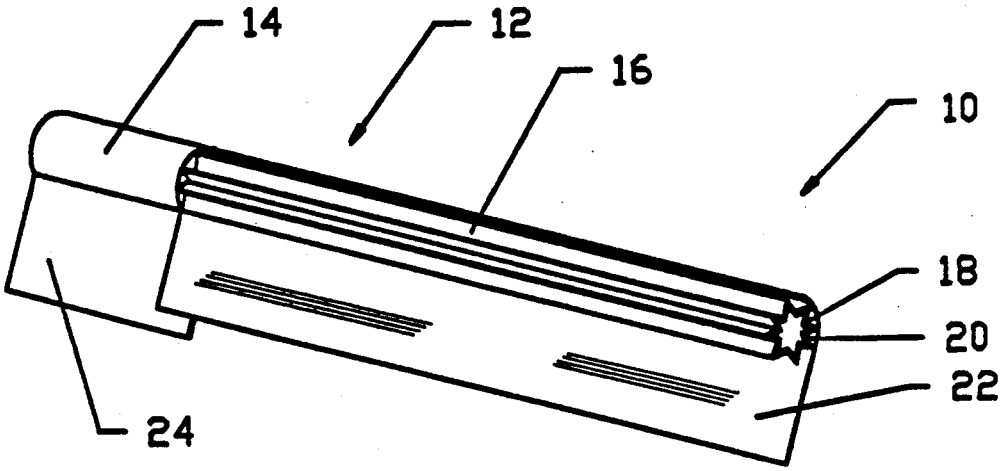
FIG. 3 is a perspective view of the cigarette of FIG. 1 with the paper for the tobacco portion and the tipping paper for the filter end portion shown in an unwrapped condition.

With reference to FIGS. 1–3, there is shown a cigarette 10 which includes a tube 12 of tobacco material and a filter rod 14.

The tobacco tube 12 has a circumferential wall 16 fabricated of a tobacco material. The circumferential tube wall 16 is corrugated with the grooves 18 and ridges 20 of the corrugations extending longitudinally of the tobacco tube 12 the entire length of the tobacco tube 12.

A wrapper 22 of combustible material circumscribes the outside peripheral surface of the tobacco tube 12 and is in contact with the ridges 20 of the corrugations. The wrapper 20 can be, for example, a paper or tobacco material.

The smoke rod filter 14 is coaxially located with the tobacco tube 12 at one end of the tobacco tube 12. The filter rod 14 is affixed to the wrapped tobacco tube 12 by a tipping material 24. The tipping material 24 circumscribes the filter rod 14 and circumferentially overlaps the wrapped tobacco tube 12 at the end of the tobacco tube 12 adjacent the filter rod 14.

Figure 4:
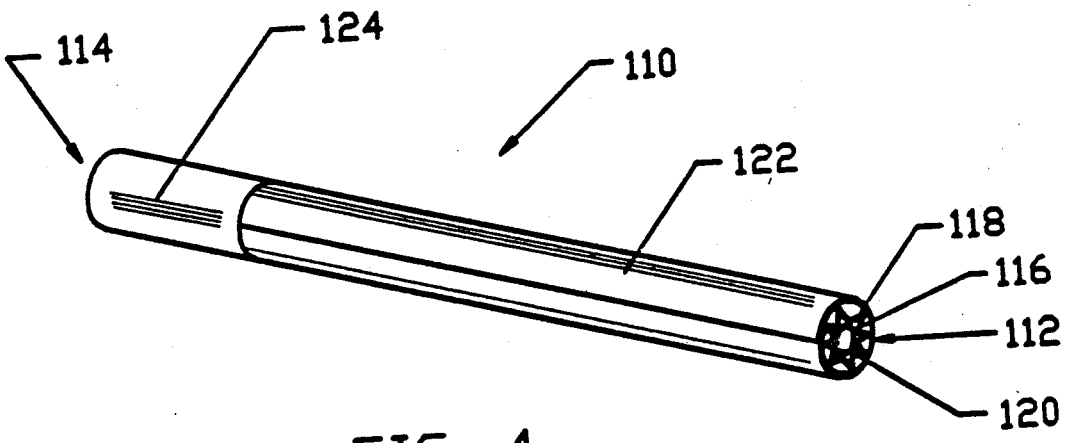
FIG. 4 is a perspective view of another preferred embodiment of a cigarette of the present invention.
Figure 5:
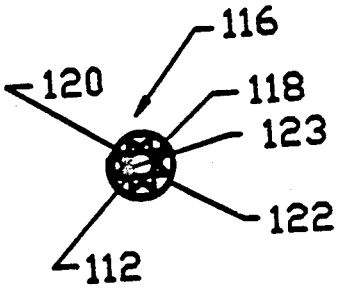
FIG. 5 is an end view of the tobacco end of the cigarette of FIG. 4.
Figure 6:
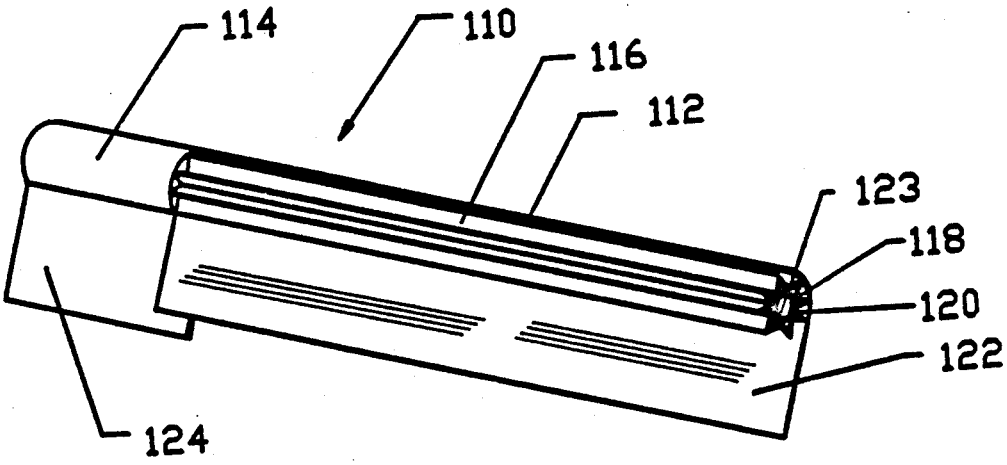
FIG. 6 is a perspective view of the cigarette of FIG. 4 showing the paper wrapper and tipping material around the tobacco rod and the filter in an unwrapped condition.

With reference to FIGS. 4–6, there is shown a cigarette 110 which includes a tube 112 of tobacco material and a filter rod 114.

The tobacco tube 112 has a circumferential wall 116 fabricated of a tobacco material. The circumferential wall 116 is corrugated with the grooves 118 and ridges 120 of the corrugations extending longitudinally the entire length of the tobacco tube 112.

A first wrapper 122 of combustible material circumscribes the outside peripheral surface of the tobacco tube 116 and is in contact with the ridges 120 of the corrugations. The first wrapper 122 can be, for example, paper or tobacco material.

A second wrapper 123 of combustible material circumscribes the inside peripheral surface of the tobacco tube 116 and is in contact with the ridges 120 of the corrugations. The second wrapper 123 can be, for example, a paper or tobacco material.

The filter rod 114 is coaxially located with the tobacco tube 112 at one end of the tobacco tube 112. The filter rod 114 is affixed to the wrapped tobacco tube 112 by a tipping material 124. The tipping material 124 circumscribes the filter rod 114 and circumferentially overlaps the wrapped tobacco tube 112 at the end of the tobacco tube 112 adjacent the filter rod 114.

Figure 7:
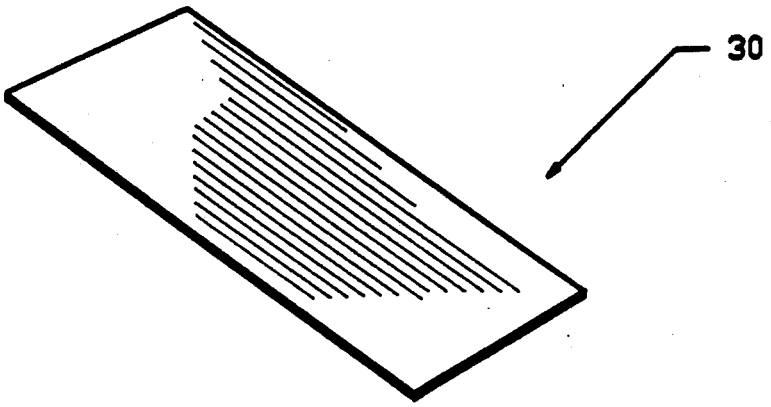
FIG. 7 is a perspective view of a flat sheet of tobacco material used in the present invention.

Referring now to FIG. 7, the tobacco tube 12, 112 of the cigarette 10, 110 is manufactured by forming a flat sheet 30 of tobacco material. The tobacco sheet 30 can be formed of, for example, reconstituted tobacco material. A number of processes are well known in the art for making such sheets 30 of tobacco material. By way of example, such sheets 30 of tobacco material can be manufactured by mixing tobacco material such as particles of tobacco leaves, stems, veins, and fines with water to form a slurry. Binder material, such as Guar gum, methylcellulose, sodium carborxymethylcellulose, is added to the slurry to assist in forming a coherent sheet of tobacco material. The slurry is then cast or formed into the flat sheet 30 and the water is removed by, for example, heating the sheet 30 of tobacco material.

Figure 8:
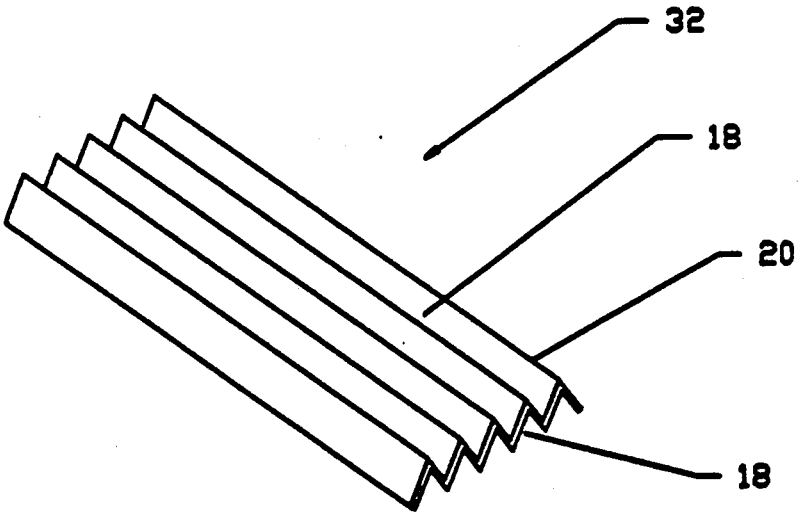
FIG. 8 is a perspective view of a corrugated sheet of the tobacco material of FIG. 7.

With reference now to FIG. 8, a corrugated sheet 32 of tobacco material is made from the flat sheet 30 by forming a series of sequential, parallel, alternating back and forth folds in the sheet 30 to form the corrugations defining the alternating grooves 18 and ridges 20.

Figure 9:
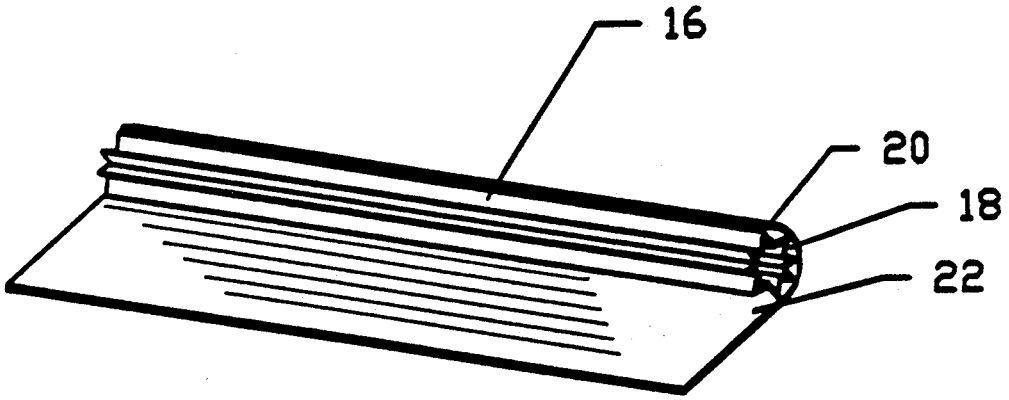
FIG. 9 is a perspective view of the corrugated tobacco sheet of FIG. 8 in a rolled condition with the paper wrapper shown in an unwrapped condition.

With reference to FIG. 9, the corrugated sheet 32 is folded to form the cylindrical tube 12, of the cigarette 10 shown in FIGS. 1 and 2 with the grooves 18 and ridges 20 extending longitudinally of the cylindrical tube 12. The longitudinal edges of the folded corrugated sheet 32 can be adhesively attached together to maintain the sheet 32 in the cylindrical configuration of the tube 12. The cylindrical tobacco tube 12 is circumferentially wrapped with the wrapper 22 and the longitudinal edges of the wrapper 22 are overlapped and adhesively affixed together.

Figure 10:
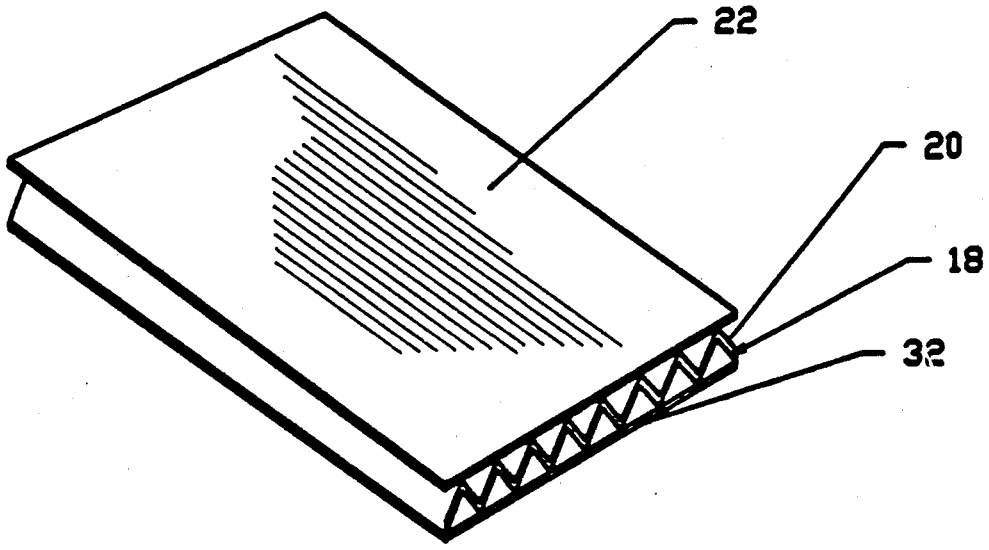
FIG. 10 is a perspective view of an alternative to the corrugated tobacco sheet of FIG. 4; and, FIG. 11 is a perspective view of the tobacco sheet used in the construction of the cigarette shown in FIG. 4.

FIG. 10 illustrates an alternative to the construction of FIG. 9. In FIG. 10, a sheet of the wrapper 22 is placed on one side of the corrugated sheet 32 of tobacco material in contact with the ridges 20 of the corrugations. The corrugated sheet 32 is then folded into the shape of a tube with the ridges 20 and grooves 18 extending longitudinally of the tube and with the wrapper 22 on the outside periphery of the tobacco tube 12.

Figure 11:
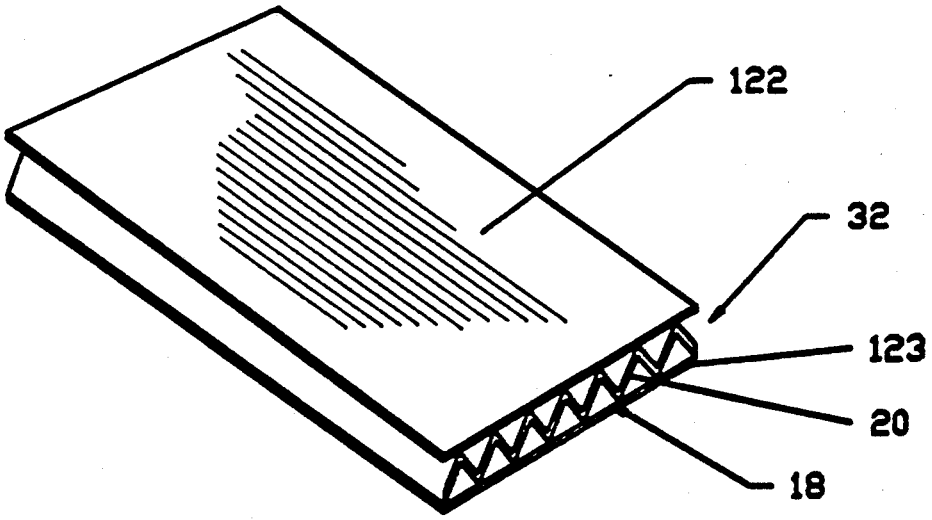

FIG. 11 illustrates construction for the tobacco tube 112 of the cigarette 10 shown in FIG. 4. In FIG. 11 a sheet of wrapper 122 is placed on one side of the corrugated sheet 32 of tobacco material in contact with ridges 20 of the corrugations, and another sheet of wrapper 123 is placed on the other side of the corrugated sheet 32 of tobacco material in contact with the ridges 20 of the corrugations. The corrugated sheet 32 is then folded into the shape of a tube with the grooves 18 and ridges 20 extending longitudinally of the tube, with the wrapper 122 on the outside periphery of the tobacco tube, and with the wrapper 123 on the inside periphery of the tobacco tube.

The draw effort exerted by a smoker puffing on the filter rod end of the cigarette can be determined by selecting different materials for the filter rod, or selecting different filter rod material density to provide a pressure drop across the filter rod which produces a draw effort of a conventional filtered cigarette.

The foregoing detailed description is given primarily for clearness of understanding and no unnecessary limitations are to be understood therefrom for modifications will become obvious to those skilled in the art upon reading this disclosure and may be made without departing from the spirit of the invention or scope of the appended claims.

What is claimed is:

1. A cigarette comprising:

a tube of tobacco material having a circumferential wall fabricated of a tobacco material formed with longitudinally extending grooves and ridges in its outside peripheral surface and longitudinally extending grooves and ridges formed in its inside peripheral surface;

a wrapper of combustible material circumscribing the outside peripheral surface of the tobacco tube in contact with the ridges of the tobacco tube;

a smoke filter rod coaxially located with the tobacco tube at one end thereof; and, tipping material circumferentially overlapping the wrapped tobacco tube at the end thereof adjacent the filter rod.

2. The cigarette of claim 1, further comprising a wrapper of combustible material circumscribing the inside peripheral surface of the tobacco tube in contact with the ridges of the tobacco tube.

3. The cigarette of claim 1, wherein the circumferential wall of the tobacco tube is corrugated to define the ridges and grooves in both the outside peripheral surface and inside peripheral surface of the tobacco tube.

4. The cigarette of claim 3, wherein the tobacco tube comprises a sheet of corrugated tobacco material folded into a generally cylindrical tube with the ridges and grooves defined by the corrugations extending longitudinally of the tube.

5. A method of making a cigarette comprising the steps of:

forming a sheet of tobacco material;

forming corrugations in the sheet of tobacco;

folding the corrugated sheet of tobacco material into a generally cylindrical tube;

wrapping a first sheet of combustible material circumferentially around the outside peripheral surface of the tobacco tube in contact with the ridges of the corrugations;

locating a smoke filter rod coaxially with the tobacco tube at one end thereof; and, folding a tipping material circumferentially overlapping the wrapped tube of tobacco at the end of the tube of tobacco adjacent the filter end.

6. The method of claim 5, comprising the further intermediate step of after forming corrugations in the tobacco sheet, overlaying one corrugated surface of the corrugated sheet with a second sheet of combustible material in contact with the ridges of the corrugations; and folding the corrugated sheet into a cylindrical tube with the second sheet of combustible material located on the inside peripheral surface of the resulting cylindrical tube.

7. A method of making a cigarette comprising the steps of:

forming a sheet of tobacco material;

forming corrugations in the sheet of tobacco;

overlaying one corrugated surface of the corrugated sheet with a first sheet of combustible material in contact with the ridges of the corrugations;

folding the corrugated sheet into a cylindrical tube with the first sheet of combustible material located on the outside peripheral surface of the resulting cylindrical tube;

locating a smoke filter rod coaxially with the tobacco tube at one end thereof; and, folding a tipping material circumferentially around the filter rod and circumferentially overlapping the wrapped tube of tobacco at the end of the tube of tobacco adjacent the filter rod.

8. The method of claim 7, comprising the further intermediate step of after forming corrugations in the tobacco sheet overlaying the opposite corrugated surface sheet of the tobacco with a second sheet of combustible material in contact with the ridges of the corrugations, that when the corrugated sheet is folded into a cylindrical tube the second sheet of combustible material is located on the inside peripheral of the resulting tube.

* * * * *